United States Patent [19]

Krysiak et al.

[11] 4,203,556

[45] May 20, 1980

[54] GRINDING DEVICE

[75] Inventors: William J. Krysiak, Wilmington; Richard L. Moyer, Newark, both of Del.

[73] Assignee: Betz Laboratories, Inc., Trevose, Pa.

[21] Appl. No.: 958,223

[22] Filed: Nov. 6, 1978

[51] Int. Cl.[2] ..... B02C 18/18

[52] U.S. Cl. ..... 241/86.1; 241/89.3; 241/244

[58] Field of Search ..... 241/89.3, 86.1, 89.4, 241/92, 278 R, 277, 245, 248, 244

[56] References Cited

U.S. PATENT DOCUMENTS

| | | | |
|---|---|---|---|
| 3,384,311 | 5/1968 | Eklund et al. | 241/278 R X |
| 3,631,909 | 1/1972 | Otto | 241/89.4 |

FOREIGN PATENT DOCUMENTS

| | | | |
|---|---|---|---|
| 1148734 | 5/1963 | Fed. Rep. of Germany | 241/89.4 |

*Primary Examiner*—Mark Rosenbaum

*Attorney, Agent, or Firm*—Alexander D. Ricci; Steven H. Markowitz

[57] ABSTRACT

A grinding device is disclosed in which material to be ground is fed axially to a rotating plate on which two sets of blades are mounted. A first inner set of slinger blades forces the material outwardly to a second set of grinding blades. The inner edges of the grinding blades are tilted forward of the outer edges thereof in the direction of blade rotation. Also, the grinding blades are adjustably supported on support plates.

18 Claims, 3 Drawing Figures

GRINDING DEVICE

The present invention relates to a grinding device, and more particularly to a material grinding device which utilizes rotary grinding blades and a perforated shear plate. Since a grinding device in accordance with the present invention is considered to be particularly useful as it relates to grinding polymeric materials, the present invention will be described in terms of a polymer grinding device.

BACKGROUND OF INVENTION

The use of a grinding device for grinding polymeric material is well known. According to a prior polymer grinding device, polymer to be ground is fed axially to a rotating plate on which are mounted a ring of grinding blades. The axially fed polymer is forced outwardly along the rotating plate to the grinding blades. Arranged tangentially with respect to the rotating plate is a perforated shear plate. Polymer which has been forced outwardly to the grinding blades is caught between the outer edges of the grinding blades and the perforations in the shear plate and is accordingly sheared to smaller particle sizes. Due to extremely close tolerance requirements between the outer edges of the grinding blades and the perforated shear plate and the absence of means for effectively adjusting the grinding blades radially outwardly, these blades have been discarded when they become worn.

SUMMARY OF INVENTION

According to the present invention, a grinding device of the type described above is provided which not only eliminates the need to discard the grinding blades once they become worn, but which also operates with significantly increased efficiency.

According to one feature of a grinding device according to the present invention, the grinding blades are arranged "radially obliquely" on the rotating plate, that is, with the inside edge of each blade tilted forward, in the direction of blade rotation, of the outer edge thereof. It has been found that as a result of this blade tilting the efficiency of the grinding device can be significantly increased, apparently due to the fact that the polymer is more effectively trapped between the grinding blades and the shear plate. It is believed that the reason the prior device is less efficient is because the radial grinding blades used therewith permit some of the polymer to travel inwardly along the rotating plate and away from the shear plate.

According to another feature of a grinding device according to the present invention, the tilted grinding blades are each supported on and are perpendicularly adjustable with respect to a support plate which extends along the rotating plate parallel to the supported grinding blade. This provides for suitable adjustment of the grinding blade within the already noted close tolerance requirements between the blade edge and the shear plate.

These and other objects, features and advantages of a grinding device according to the present invention will become more apparent from the following detailed description, particularly when considered in conjunction with the accompanying drawing wherein like reference numerals are used throughout to indicate like parts and wherein.

Figure 1:
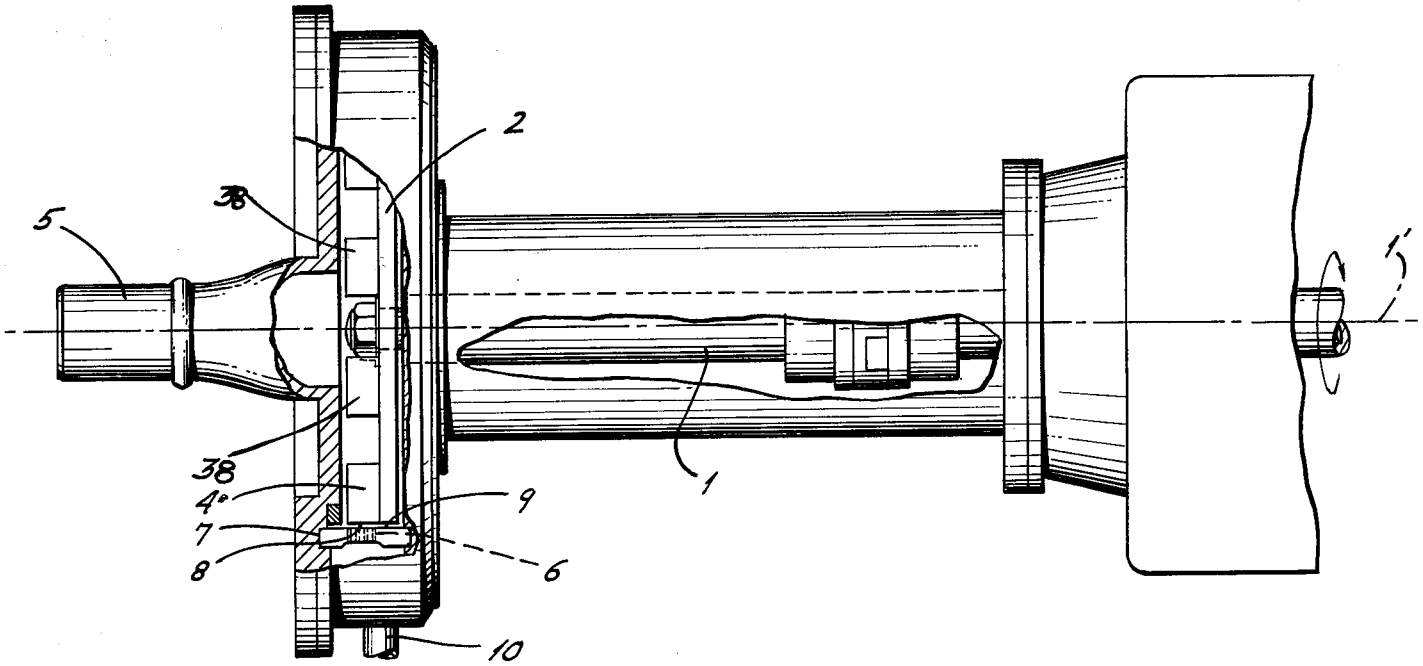
FIG. 1 is a schematic elevational view of a grinding device in accordance with the present invention.

With reference to the drawings, wherein a preferred embodiment of a grinding device according to the present invention is shown for purposes of illustration only, and with particular reference to FIG. 1, reference numeral 1 indicates a rotating shaft, one end of which is connected to rotor means 2 which rotor means takes the form of a disc-shaped rotor plate. The other end of shaft 1 is, of course, connected by known means to driving means (not shown) such as an electric motor. As is seen to be quite clear from the drawing, rotor plate 2 is rotatable about a rotor axis 1'. Polymer to be ground is fed to rotor plate 2 through inlet 5. As can be seen in FIG. 1, the polymer to be ground is fed "axially" to the rotor plate, that is, in a direction which is generally parallel to rotor axis 1'. Mounted on the rotor plate are a set of slinger blades 38 and a set of grinding blades 4. The slinger blades are located radially inwardly of the grinding blades, that is, closer to axis 1'; and they serve to force polymer that has been fed via inlet 5 to rotor plate 2 outwardly along rotor plate 2 to the grinding blades. Shear plate 7 has a plurality of openings 6 extending therethrough and preferably takes the form of a perforated disc. Grinding blades 4 force polymer particles received from the slinger blades 38 partially into the openings 6 in shear plate 7, creating a shearing action on the particles at the interface between the outer edge 8 of the grinding blades and the upper surface 9 of the shear plate at the openings. Of course, polymer particles which have been ground to sizes small enough to fall through openings 6 will exit from the grinding device through outlet 10.

Figure 2:
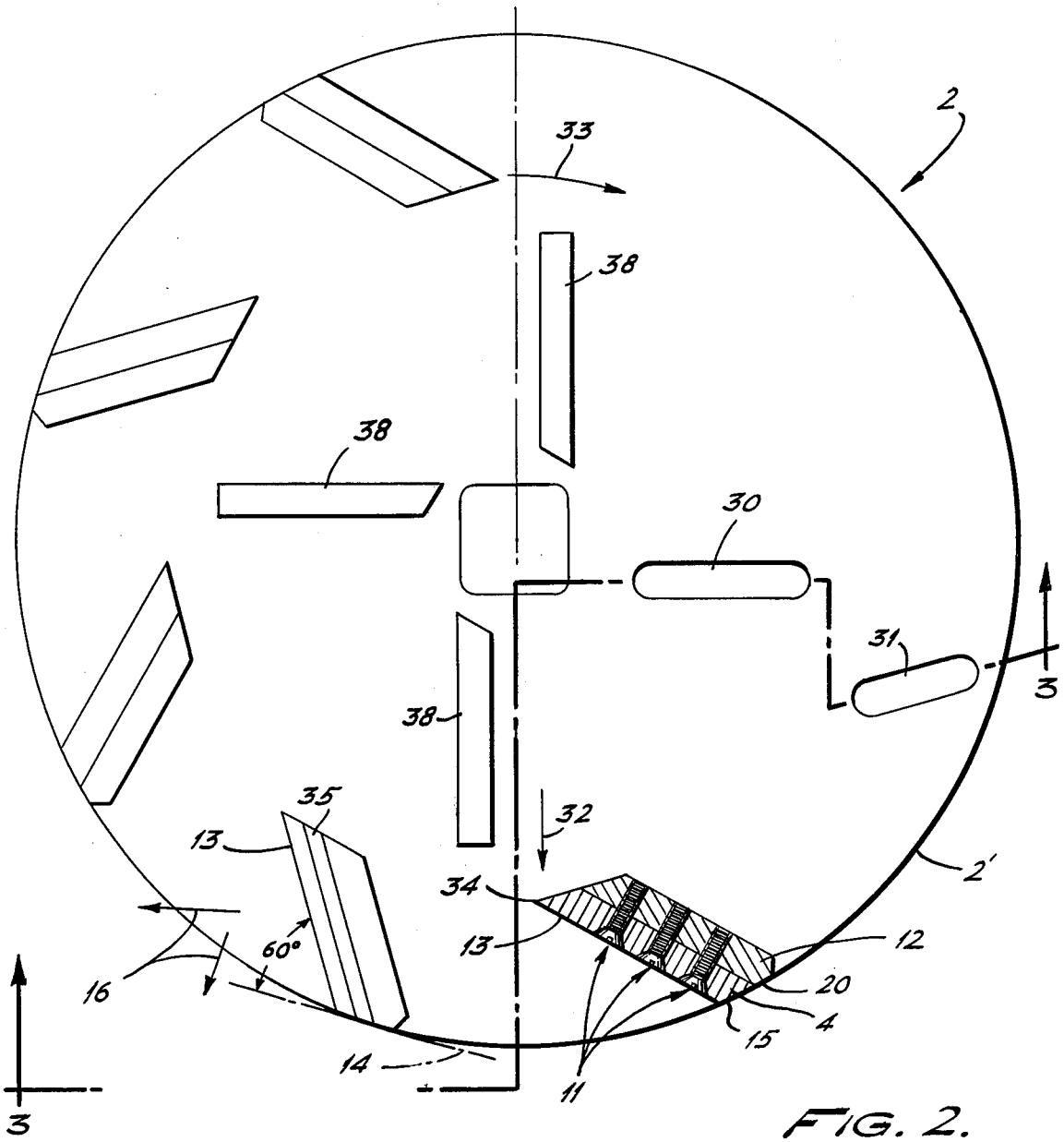
FIG. 2 is a plan view of a rotor plate and blades in accordance with the present invention.
Figure 3:
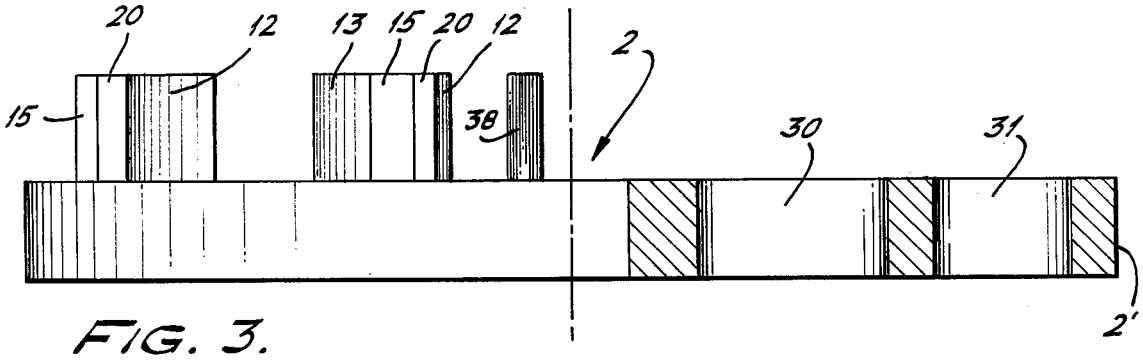
FIG. 3 is a partial sectional view of the rotor plate and blades illustrated in FIG. 2 and is taken along sight line 3—3 shown in FIG. 2.

With particular reference now to FIG. 2, rotor plate 2 is preferably disc-shaped and is provided with a series of slot-like openings 30 and 31 for receiving slinger blades 38 and grinding blades 4, respectively. Preferably, a plurality of equally spaced slinger blades are provided to form an inner ring of slinger blades. As already noted, it is the purpose of the slinger blades to force polymer particles to be ground outwardly along rotor plate 2 to grinding blades 4, along a path as generally indicated by directional arrow 32. The slinger blades are preferably made of steel, although as is well known other materials could be used to suit a particular use. Grinding blades 4 are located radially outwardly of slinger blades 38 and are, preferably, equally spaced about rotor plate 2 to provide an outer ring of blades which outer ring is concentric with respect to the inner ring of slinger blades. Since the illustrated device serves the purpose of grinding polymers by shearing action created between the outer edges 15 of the grinding blades and the upper surface 9 of the shear plate 7, these outer edges 15 are preferably flat, and are most preferably contoured to the shape of the rotor plate periphery 2'. The grinding blades are also, preferably, coterminal with the rotor plate periphery 2'. As already mentioned, it has been discovered that the efficiency of the grinding device can be effectively increased by arranging grinding blade 4 radially obliquely on rotor plate 2, that is, by tilting the inner edge 34 of the grinding blade forward of the outer edge 15 thereof in the direction of blade rotation 33. This blade orientation more effectively traps the polymer particles between blade surface 13 and the shear plate, making it more difficult for the particles to slide back along surface 13 toward slinger blades 38. It is preferred that the grinder blade is tilted to about 60°, that is, that inner surface 13 makes an angle of about 60° with a tangent 14 drawn through the intersection of inner surface 13 with plate periphery 2'. Based on experience, it is believed that this angle of tilt could be as small as about 45° or as great as about 80°.

Grinding blades 4 are each preferably supported on rotor plate 2 by a "parallel" support plate 12, that is, a support plate which extends along the rotor plate surface in the same direction as the corresponding supported grinding blade. The outer edge 20 of the support plate is, preferably, also contoured to the shape of and coterminal with the periphery of the rotor plate. It is preferred that the grinding blade is supported on the support plate by screws 11. As already mentioned above, a problem experienced with the radially arranged grinding blades was that once the grinding (outer) edge of the blade wore out, the blade was thrown away, due to both the extremely close tolerance requirements between the blade edge and the upper surface 9 (FIG. 1) of shear plate 7 and the lack of reliable means for adjusting the radial blade radially outwardly. According to one aspect of the present invention this problem has been effectively overcome in that the edge 15 of the grinding blade 4 can be perpendicularly adjusted outwardly from the support plate by simply placing a shim, such as a thin metal plate 35, between support plate 12 and the blade. Due to the angle of the blade, the interposed shim will have moved the blade both away from the mounting plate and radially outwardly along rotor plate 2 as shown in FIG. 2 by arrows 16.

While a preferred embodiment according to the present invention has been shown and described, it is understood that the same is not limited thereto but is susceptible to numerous changes and modifications as known to those skilled in the art, and it is therefore intended that the scope of the appended claims not be limited to the details shown and described herein but rather that the claims cover all such changes and modifications as are encompassed by the scope of the claims.

What is claimed is:

1. A grinding device comprising:

rotor means rotatable about a rotor axis, grinding blade means mounted on said rotor means for rotation in a given direction, shear plate means arranged tangentially with respect to said rotor means, said shear plate means having perforations for shear-cutting material in cooperation with said grinding blade means, and means for axially feeding material to be ground to said rotor means, wherein each of said grinding blade means has an inner edge and an outer edge, the inner edge of each blade means being tilted forward of the outer edge thereof in the direction of blade rotation, wherein each of said grinding blade means is supported on said rotor means by a parallel support plate, and wherein each grinding blade means is perpendicularly adjustable with respect to its corresponding support plate.

2. The grinding device of claim 1, wherein each blade is tilted to from about 45° to 80°.

3. The grinding device of claim 2, wherein each blade is tilted to about 60°.

4. The grinding device of claim 2, wherein said rotor means is disc-shaped, and wherein the outer edge of each grinding blade means is contoured to the peripheral shape of said rotor means.

5. The grinding device of claim 4, wherein the outer edge of each blade means is coterminal with the periphery of said rotor means.

6. The grinding device of claim 5, further comprising slinger blade means mounted on said rotor means radially inwardly of said grinding blade means, said slinger blade means serving to force material to be ground outwardly along said rotor means to said grinding blade means.

7. The grinding device of claim 1, further comprising slinger blade means mounted on said rotor means radially inwardly of said grinding blade means, said slinger blade means serving to force material to be ground outwardly along said rotor means to said grinding blade means.

8. The grinding device of claim 7, wherein a plurality of said grinding blade means are provided on said rotor means to form a first ring of blade means, and wherein a plurality of said slinger blade means are provided on said rotor means to provide a second ring of blade means concentric with said first ring.

9. The grinding device of claim 8, wherein said grinding blade means are equally spaced around said rotor means.

10. The grinding device of claim 9, wherein said slinger blade means are equally spaced around said rotor means.

11. The grinding device of claim 1, wherein at least one of said grinding blade means is supported on a corresponding support plate by interposed shim means.

12. The grinding device of claim 11, wherein each grinding blade means is supported on its corresponding support plate by screw means.

13. The grinding device of claim 12, wherein each grinding blade means is tilted to about 60°.

14. The grinding device of claim 12, further comprising slinger blade means mounted on said rotor means radially inwardly of said grinding blade means, said slinger blade means serving to force material to be ground outwardly along said rotor means to said grinding blade means.

15. The grinding device of claim 14, wherein said rotor means is disc-shaped, and wherein the outer edge of each grinding blade means is contoured to the peripheral shape of said rotor means.

16. The grinding device of claim 15, wherein the outer edge of each blade means is coterminal with the periphery of said rotor means.

17. The grinding device of claim 16, wherein said rotor means is arranged to rotate in a substantially vertical plane, and wherein said shear plate means is arranged horizontally and below said rotor means.

18. The grinding device of claim 17, wherein a plurality of said grinding blade means are provided on said rotor means to form a first ring of blade means, and wherein a plurality of said slinger blade means are provided on said rotor means to provide a second ring of blade means concentric with said first ring.

* * * * *